US008739763B2

(12) United States Patent
Harvey et al.

(10) Patent No.: US 8,739,763 B2
(45) Date of Patent: Jun. 3, 2014

(54) FUEL INJECTOR ASSEMBLY

(75) Inventors: William T. Harvey, Brighton, MI (US); Steven J. Miller, Livonia, MI (US); Hiroaki Saeki, West Bloomfield, MI (US)

(73) Assignee: Hitachi Automotive Systems Americas Inc., Harrodsburg, KY (US)

( * ) Notice: Subject to any disclaimer, the term of this patent is extended or adjusted under 35 U.S.C. 154(b) by 625 days.

(21) Appl. No.: 13/028,616

(22) Filed: Feb. 16, 2011

(65) Prior Publication Data

US 2012/0204837 A1 Aug. 16, 2012

(51) Int. Cl.
*F02M 1/00* (2006.01)

(52) U.S. Cl.
USPC ..... 123/470; 248/678

(58) Field of Classification Search
USPC ..... 123/470, 468, 469, 456; 248/678, 65, 248/73
See application file for complete search history.

(56) References Cited

U.S. PATENT DOCUMENTS

| | | | | |
|---|---|---|---|---|
| 7,406,946 | B1 * | 8/2008 | Watanabe et al. | 123/470 |
| 7,527,038 | B2 * | 5/2009 | Watanabe et al. | 123/470 |
| 7,856,962 | B2 | 12/2010 | Harvey et al. | |
| 8,087,398 | B2 * | 1/2012 | Harvey et al. | 123/470 |
| RE43,864 | E * | 12/2012 | Watanabe et al. | 123/470 |
| 2004/0050366 | A1 * | 3/2004 | Kato | 123/470 |
| 2007/0266996 | A1 * | 11/2007 | Zdroik et al. | 123/445 |
| 2008/0264386 | A1 * | 10/2008 | Watanabe et al. | 123/456 |
| 2010/0300409 | A1 * | 12/2010 | Harvey et al. | 123/470 |
| 2011/0073074 | A1 * | 3/2011 | Hay et al. | 123/456 |

OTHER PUBLICATIONS

GM High Feature engine—http://en.wikipedia.org/wiki/GM_High_Feature_engine.com.
GM Family II engine—http://en.wikipedia.org/wiki/GM_Family_II_engine.com.

* cited by examiner

*Primary Examiner* — John Kwon
(74) *Attorney, Agent, or Firm* — Gifford, Krass, Sprinkle, Anderson & Citkowski, P.C.

(57) ABSTRACT

A fuel injector assembly for use with an engine block of a direct injection engine. The fuel injector assembly includes an elongated tubular fuel rail which is fluidly connected to a high pressure fuel source. At least two fuel cups are attached to and extend downwardly from the fuel rail and each fuel cup is adapted to receive one fuel injector. First fasteners attach a bracket to the engine block while second fasteners attach the bracket to the fuel rail. These second fasteners, furthermore, are positioned so that the second fasteners are coplanar with a plane extending through a longitudinal axis of each fuel injector.

17 Claims, 2 Drawing Sheets

FUEL INJECTOR ASSEMBLY

BACKGROUND OF THE INVENTION

I. Field of the Invention

The present invention relates generally to fuel injector assemblies and, more particularly, to a fuel injector assembly for a direct injection engine.

II. Description of Material Art

Many modern day automotive vehicles utilize direct fuel injection into a combustion engine to propel the vehicle. Such direct injection engines enjoy increased fuel economy as well as relatively lightweight and compact construction.

In a direct injection engine, bores are formed through the engine block to each of the cylinders contained in the engine. A fuel injector is then positioned within each fuel injector bore so that one end of the fuel injector is open to one of the combustion chambers for the engine. Consequently, upon activation, the fuel injectors inject the fuel directly into the combustion chamber rather than upstream from the combustion chamber as in the previously known multipoint fuel injection systems.

In order to supply fuel to the fuel injectors, a fuel rail extends along the side or top of the engine so that the fuel rail overlies the fuel injector bores to the combustion chambers. The fuel rail is secured to the engine block by a bracket and includes one fuel cup for each fuel injector for the engine. Thus, with a fuel inlet end of the fuel injector positioned in the cup and the fuel outlet end positioned in the fuel injector bore in the engine block, upon activation or opening of the fuel injector, pressurized fuel from the fuel rail passes through the fuel injector and directly into the combustion chamber. An engine control unit (ECU) provides electrical output signals to each of the fuel injectors to open the fuel injectors at the desired time and for the desired duration.

Because the fuel is injected directly into the combustion chamber, the fuel injection from the fuel injectors must necessarily be high pressure sufficient to overcome the pressure in the engine combustion chamber. This high pressure fuel injection thus necessarily exerts an outward force onto the fuel rail bracket each time the fuel injector is opened.

One disadvantage of these previously known direct injection engines is that the bracket for the fuel rail is typically attached to the side of the rail. However, during the operation of the engine, the force exerted by the fuel injectors onto the rail each time the fuel injector was opened or activated imposed a torsional load on the fuel rail. Indeed, in some cases, the torsional force on the fuel rail caused by activation of the fuel injectors even imparted a torsional force not only on the fuel rail bracket, but also on the fuel injectors themselves.

A still further disadvantage of direct injection internal combustion engines is that any vibration between the fuel bracket and the fuel rail creates noise from the engine. This noise, furthermore, is most noticeable, and thus most objectionable, when the engine is at slow or idle speeds.

SUMMARY OF THE PRESENT INVENTION

The present invention provides a fuel injector assembly which overcomes all of the above-mentioned disadvantages of the previously known devices.

In brief, the fuel injector assembly of the present invention is particularly well suited for a direct fuel injection engine and includes an elongated tubular fuel rail that is adapted to be connected to a high pressure fuel source. The high pressure in the fuel rail is sufficient to overcome the pressure in the engine combustion chambers.

A plurality of fuel cups are attached to and extend outwardly from one side of the fuel rail. One fuel cup is associated with each fuel injector. Consequently, the number of cups extending outwardly from the rail or rails corresponds to the number of combustion chambers in the engine.

In the conventional fashion, a fuel injector bore is provided through the engine block to each combustion chamber in the engine. Each fuel injector bore, furthermore, is dimensioned to slidably receive an outlet end of the fuel injector associated with that combustion chamber. Simultaneously, an inlet end of the fuel injector is positioned within a fuel cup extending outwardly from the fuel rail.

A bracket supports the fuel injector cups, and thus the inlet ends of the fuel injectors outside of the engine block so that the fuel cups overlie the fuel injector bores formed through the engine block. This bracket, furthermore, is rigidly secured to the engine block by conventional fasteners, such as bolts.

Second fasteners are employed to secure the fuel rail to the bracket. Preferably, these second fasteners comprise a plurality of pins which are secured to and extend outwardly from a side of the fuel rail opposite from the fuel cups. These pins are positioned through receiving holes in the bracket and are secured to the bracket by a lock nut.

In order to minimize, or altogether eliminate, torsional forces on the fuel rail, the pins are positioned so that they are coplanar with a plane extending through the axes of the fuel injectors when positioned in their respective fuel cups. Consequently, since the second fasteners are aligned with the plane of the fuel injectors, torsional load on the fuel rail caused by the high pressure fuel injection into the engine combustion chambers is avoided.

In order to minimize any noise that may be caused by vibration between the fuel rail and the bracket, at least one and preferably a pair of elastomeric washers are positioned over each pin so that one elastomeric washer is positioned on each side of the bracket. These elastomeric washers thus absorb any vibration between the bracket and the fuel rail thus dampening the noise that would otherwise be caused by a direct metal-to-metal contact between the fuel rail and the bracket.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 2:
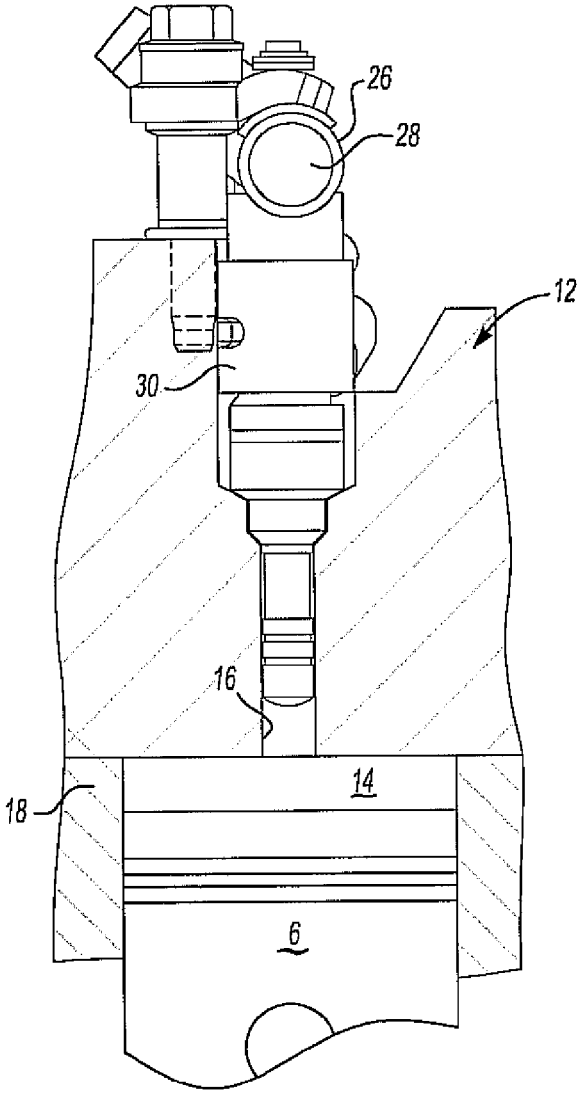
FIG. 2 is a sectional view illustrating a portion of the preferred embodiment of the invention.

With reference first to FIG. 2, a preferred embodiment of a fuel injector assembly 10 in accordance with the present invention is shown for use with a direct fuel injection engine 12. The direct injection engine 12 includes a plurality of internal combustion chambers 14 that are conventionally aligned with each other in a bank, although the engine 12 may include more than one bank of combustion chambers 14. Furthermore, a fuel injector bore 16 is provided through an engine block 18, which may be an engine header, so that one end of each fuel injector bore 16 is open to one of the combustion chambers 14.

Figure 1:
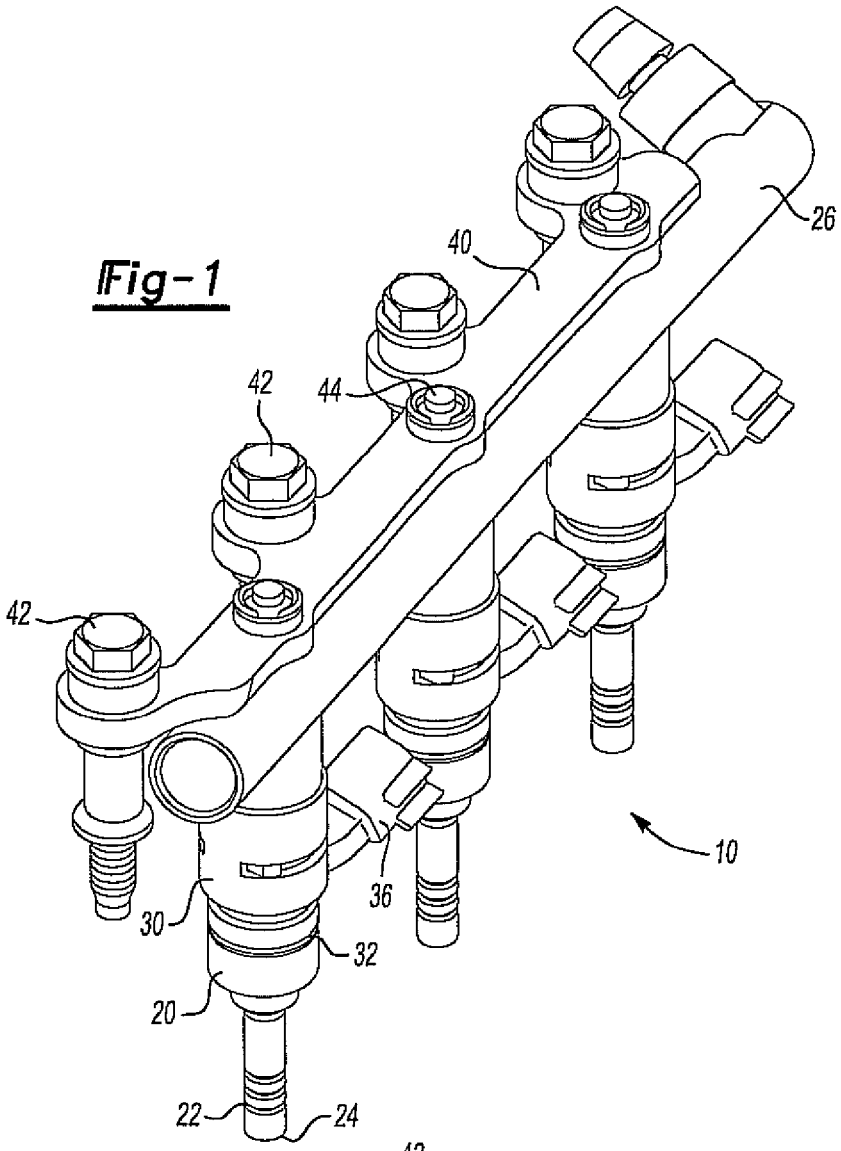
FIG. 1 is an elevational view illustrating a preferred embodiment of the present invention.

With reference to FIGS. 1 and 2, a fuel injector 20 is associated with each combustion chamber 14. The fuel injector 20 is generally elongated and includes an outlet end 22. The outlet end 22 of the fuel injector 20 is typically cylindrical in shape and dimensioned so that it is slidably received within one of the fuel injector bores 16 so that the outlet end 22 of the injector 20 is positioned at or near the combustion chamber 14.

An elongated fuel rail 26 defines an interior fuel chamber 28. In the conventional fashion, the fuel chamber 28 of the fuel rail 26 is adapted to be pressurized by a high pressure fuel pump 29.

Figure 3:
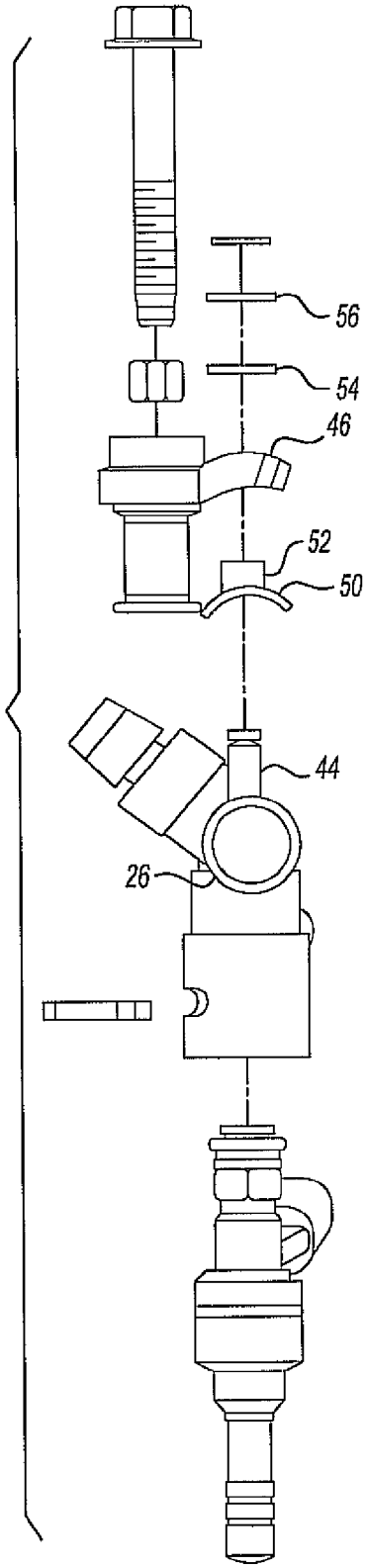
FIG. 3 is an exploded view illustrating a preferred embodiment of the present invention.

With reference to FIGS. 1-3, a fuel cup 30 is secured to and extends outwardly from one side of the fuel rail 26. One fuel cup 30, furthermore, is associated with each fuel injector 20. An inlet end 32 (FIG. 3) of each fuel injector 20 is received within each of the fuel cups 30. A fuel port 38 (FIG. 3) fluidly connects the fuel chamber 28 in the fuel rail 26 with each fuel cup 30 and thus with the inlet end 32 of each injector 20.

With the fuel injector outlet ends 22 positioned within their receiving fuel injector bores 16 and the inlet ends 32 of the fuel injector 20 positioned within their associated fuel cup 30, the fuel injectors 20 are secured to their associated fuel cup 30 by any conventional fashion such as by a clip 35. Furthermore, an electrical connector 36 (FIG. 1) extends outwardly from each fuel injector 32. This electrical connector 36 is connected to the engine control unit (ECU) which controls both the timing of the opening of each fuel injector 20, as well as the duration of each fuel injection.

Figure 4:
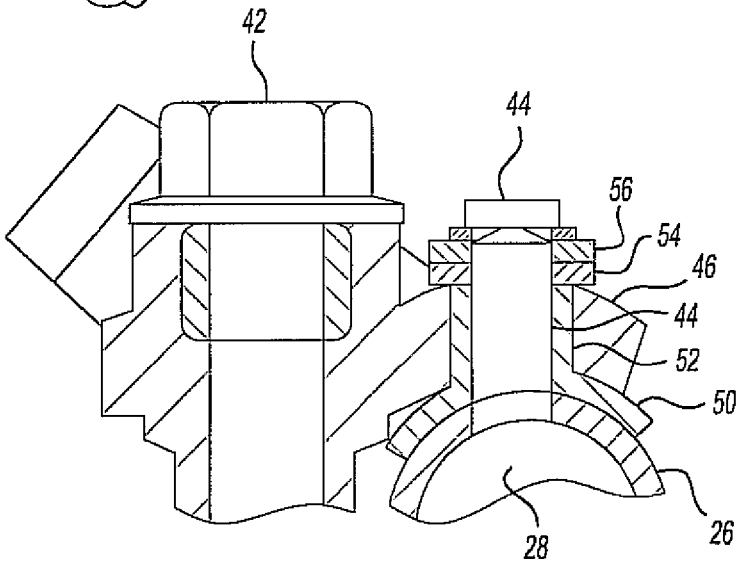
FIG. 4 is a fragmentary sectional view.

With reference now particularly to FIGS. 1, 3 and 4, an elongated bracket 40 mounts the fuel rail 26 with its attached fuel cups 30 in position above and in line with the fuel injector bores 16. A plurality of first fasteners 42, such as bolts, extend through openings in the bracket 40 and secure the bracket 40 directly to the engine block 18. These first fasteners 42, furthermore, are offset from the axis of the fuel injectors 20.

In order to attach the bracket 40 to the fuel rail a plurality of spaced pins 44 are secured to and extend outwardly from the fuel rail 26 on the side of the fuel rail 26 opposite from the fuel cups 30. Any conventional means, such as welding, can be used to secure the pins 44 to the fuel rail 26.

As best shown in FIG. 4, each pin 44 registers with a mounting hole 46 formed in the bracket 40. Thus, with the pins 44 inserted through their associated mounting holes 46, the fuel rail 26 is positioned on one side of the bracket 40 while the pins 44 protrude outwardly from the opposite side of the bracket 40.

In order to dampen any vibration between the fuel rail 26 and the bracket 40, a first elastomeric dampener 50 is positioned around the pin 44 so that the dampener 50 is sandwiched in between the bracket 40 and the fuel rail 26. Furthermore, the dampener 50 preferably includes a tubular section 52 which is positioned within the mounting hole 46 formed in the bracket 40 so that the dampener 50 dampens any vibration between the fuel rail 26 and the bracket 40.

A second elastomeric dampener 54 is also positioned around the pin 40 but on the side of the bracket 40 opposite from the fuel rail 26. Consequently, the pin 44 is completely isolated from the bracket 40 by the two dampeners 50 and 54.

With the pins 44 positioned through their mounting holes 46 in the bracket 40 and the dampeners 50 and 54 positioned around the pin as previously described, the fuel rail 26 is secured to the bracket 40 by a washer 56 and locking clip 57. The locking clip 56 is conventional in construction and lockingly engages the pin 44.

With reference now particularly to FIGS. 1 and 2, the pins 44 are coplanar with a plane 60 extending through the axis of each of the fuel injectors 20 associated with that bank of engine combustion chambers. Since the pins 44 form the sole attachment between the fuel rail 26 and the bracket 40, all torsional force on the bracket 40 which would otherwise be caused by the force of the fuel injection from the fuel injectors 20 is eliminated. This, in turn, completely eliminates any torsional force on the fuel injectors themselves, as well as their related components.

From the foregoing, it can be seen that the present invention provides a simple yet unique fuel injector assembly that is particularly suited for use with a direct injection internal combustion engine. Having described our invention, however, many modifications thereto will become apparent to those skilled in the art to which it pertains without deviation from the spirit of the invention as defined by the scope of the appended claims.

We claim:

1. A fuel injector assembly comprising:

an elongated tubular fuel rail adapted to be fluidly connected to a fuel source, at least two fuel cups attached to and extending outwardly from said fuel rail, each fuel cup adapted to receive one of fuel injectors, a bracket, first fasteners for attaching said bracket to an engine block, second fasteners for attaching said bracket to said fuel rail, said second fasteners positioned so that said second fasteners are configured to secure said fuel rail under said bracket through a longitudinal axis of each fuel injector in a bank of fuel injectors.

2. The fuel injector assembly as defined in claim 1 wherein said second fastener is configured to secure said fuel rail so that a vibration dampener is sandwiched between said bracket and said fuel rail.

3. The fuel injector assembly as defined in claim 2 wherein said dampener comprises an elastomeric material.

4. The fuel injector assembly as defined in claim 1 wherein each said second fasteners comprise a pin attached to and extending outwardly from said fuel rail, said pin extending through an opening in said bracket, and a clip attached to said pin.

5. The fuel injector assembly as defined in claim 4 wherein said clip is positioned on the side of said bracket opposite from said fuel rail.

6. The fuel injector assembly as defined in claim 4 wherein an axis of said pin lies in said plane.

7. The fuel injector assembly as defined in claim 1 wherein said second fasteners are positioned between said fuel cups.

8. The fuel injector assembly as defined in claim 1 further comprising said fuel injectors.

9. The fuel injector assembly as defined in claim 2 further comprising said fuel injectors.

10. The fuel injector assembly as defined in claim 4 further comprising said fuel injectors.

11. A vehicle comprising:

a fuel pump, an engine block, and a fuel injector assembly, wherein said fuel injector assembly comprising:

an elongated tubular fuel rail adapted to be fluidly connected to said fuel pump, at least two fuel cups attached to and extending outwardly from said fuel rail, each fuel cup adapted to receive one of fuel injectors, a bracket, first fasteners for attaching said bracket to said engine block, second fasteners for attaching said bracket to said fuel rail, said second fasteners positioned so that said second fasteners are configured to secure said fuel rail under said bracket through a longitudinal axis of each fuel injector in a bank of fuel injectors.

12. The vehicle as defined in claim 11 wherein said second fastener is configured to secure said fuel rail so that a vibration dampener is sandwiched between said bracket and said fuel rail.

13. The vehicle as defined in claim 12 wherein said dampener comprises an elastomeric material.

14. The vehicle as defined in claim 11 wherein each said second fasteners comprise a pin attached to and extending outwardly from said fuel rail, said pin extending through an opening in said bracket, and a clip attached to said pin.

15. The vehicle as defined in claim 14 wherein said clip is positioned on the side of said bracket opposite from said fuel rail.

16. The vehicle as defined in claim 14 wherein an axis of said pin lies in said plane.

17. The vehicle as defined in claim 11 wherein said second fasteners are positioned between said fuel cups.

* * * * *